US005508160A

United States Patent [19]

Maskasky

[11] Patent Number: 5,508,160

[45] Date of Patent: Apr. 16, 1996

[54] TABULARLY BANDED EMULSIONS WITH HIGH CHLORIDE CENTRAL GRAIN PORTIONS

[75] Inventor: Joe E. Maskasky, Rochester, N.Y.

[73] Assignee: Eastman Kodak Company, Rochester, N.Y.

[21] Appl. No.: 394,987

[22] Filed: Feb. 27, 1995

[51] Int. Cl.[6] ..... G03C 1/035

[52] U.S. Cl. ..... 430/567

[58] Field of Search ..... 430/567

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,414,306 | 11/1983 | Wey et al. | 430/434 |
| 4,435,501 | 3/1984 | Maskasky | 430/434 |
| 4,439,520 | 3/1984 | Kofron et al. | 430/434 |
| 4,504,570 | 3/1985 | Evans et al. | 430/598 |
| 4,783,398 | 11/1988 | Takada et al. | 430/567 |
| 4,804,621 | 2/1989 | Tufano et al. | 430/567 |
| 4,952,491 | 8/1990 | Nishikawa et al. | 430/570 |
| 4,983,508 | 1/1991 | Ishiguro et al. | 430/569 |
| 5,035,992 | 7/1991 | Houle et al. | 430/569 |
| 5,045,443 | 9/1991 | Urabe | 430/567 |
| 5,061,617 | 10/1991 | Maskasky | 430/569 |
| 5,178,997 | 1/1993 | Maskasky | 430/569 |
| 5,178,998 | 1/1993 | Maskasky et al. | 430/569 |
| 5,183,732 | 2/1993 | Maskasky | 430/569 |
| 5,185,239 | 2/1993 | Maskasky | 430/569 |
| 5,411,851 | 5/1995 | Maskasky | 430/567 |
| 5,411,852 | 5/1995 | Maskasky | 430/567 |
| 5,418,125 | 5/1995 | Maskasky | 430/567 |

*Primary Examiner*—Janet C. Baxter
*Attorney, Agent, or Firm*—Carl O. Thomas

[57] ABSTRACT

Radiation-sensitive emulsions are disclosed in which tabular grains of a face centered cubic crystal lattice structure having parallel {111} major faces and an average aspect ratio of at least 5 are comprised of a central region containing greater than 50 mole percent chloride and a tabular band containing less than 40 mole percent chloride and extending laterally outwardly from the central region to form at least 25 percent of the {111} major faces.

11 Claims, 1 Drawing Sheet

TABULARLY BANDED EMULSIONS WITH HIGH CHLORIDE CENTRAL GRAIN PORTIONS

FIELD OF THE INVENTION

The invention relates to radiation-sensitive emulsions useful in photography.

BACKGROUND

Figure 1:
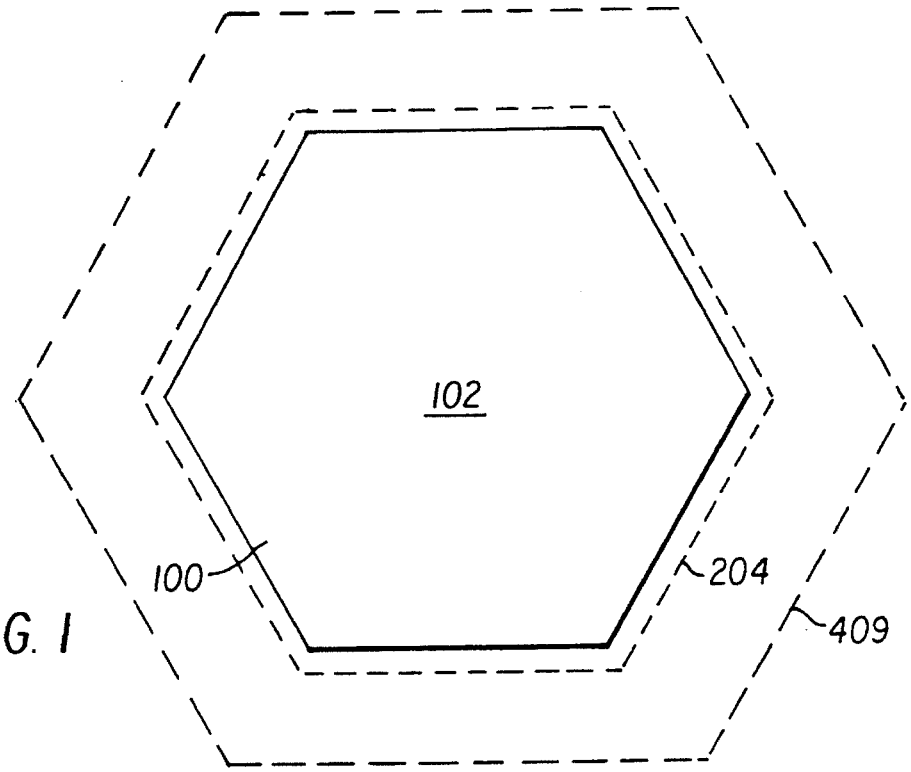
FIG. 1 is a plan view of a tabular grain with dashed lines added to demonstrate two alternate growth patterns.

During the 1980's a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected tabular grain populations in photographic emulsions.

The advantages of tabular grain emulsions stem from the high proportion of tabular grains—that is, grains with parallel {111} major faces, having a relatively large equivalent circular diameter (ECD) as compared to their thickness (t). By increasing the percentage of total grain projected area accounted for tabular grains, increasing the aspect ratio of the tabular grains (ECD÷t), and decreasing grain thickness, the advantages imparted by tabular grain geometries can be enhanced.

From the very outset it was recognized that tabular grains with {111} major faces could be prepared by introducing parallel twin planes in the face centered cubic crystal lattice structure of silver bromide grains. It was subsequently discovered that the desired tabular grain characteristics could, with proper precautions, be maintained when minor amounts of iodide were incorporated.

Forming tabular grains wholly or partly containing regions of high (>50 mole %) chloride was recognized from the outset to be relatively challenging, since silver chloride prefers to form grains with {100} crystal faces rather than the {111} major faces required for tabular grains produced by parallel twin planes.

Although commercial photographic applications for tabular grain emulsions are currently served almost exclusively by silver bromide and iodobromide tabular grain emulsions, recent interest has developed in improving high chloride tabular grain emulsions to create an attractive alternative. High chloride grains are ecologically preferred and offer the potential of more rapid processing.

Wey U.S. Pat. No. 4,399,215 produced the first silver chloride high aspect ratio (ECD/t>8) tabular grain emulsion. An ammoniacal double-jet precipitation technique was employed. The average aspect ratio of the emulsions was not high compared to contemporaneous silver bromide and bromoiodide tabular grain emulsions because the ammonia thickened the tabular grains. A further disadvantage was that significant reductions in tabularity occurred when bromide and/or iodide ions were included in the tabular grains.

Wey et al U.S. Pat. No. 4,414,306 developed a process for preparing silver chlorobromide emulsions containing up to 40 mole percent chloride based on total silver. This process of preparation has not been successfully extended to high chloride emulsions.

Maskasky U.S. Pat. No. 4,400,463 (hereinafter designated Maskasky I) developed a strategy for preparing a high chloride, high aspect ratio tabular grain emulsion capable of tolerating minor inclusions of the other halides. The strategy was to use a particularly selected synthetic polymeric peptizer in combination with a grain growth modifier having as its function to promote the formation of {111} crystal faces. Adsorbed aminoazaindenes, preferably adenine, and iodide ions were disclosed to be useful grain growth modifiers. The principal disadvantage of this approach has been the necessity of employing a synthetic peptizer as opposed to the gelatino-peptizers almost universally employed in photographic emulsions.

This work has stimulated further investigations of grain growth modifiers for preparing tabular grain high chloride emulsions, as illustrated by Takada et al U.S. Pat. No. 4,783,398, which employs heterocycles containing a divalent sulfur ring atom; Nishikawa et al U.S. Pat. No. 4,952,491, which employs spectral sensitizing dyes and divalent sulfur atom containing heterocycles and acyclic compounds; Ishiguro et al U.S. Pat. No. 4,983,508, which employs organic bis-quaternary amine salts; Tufano et al U.S. Pat. No. 4,804,621, which employs selected 4,6-diaminopyrimidines capable of promoting the formation of tabular grains, but excludes the possibility of having an amino substituent present in the 5-position on the pyrimidine ring; Maskasky U.S. Pat. No. 5,061,617 (hereinafter designated Maskasky II), which employs thiocyanate as a grain growth modifier; Maskasky U.S. Pat. No. 5,178,997 (hereinafter designated Maskasky III), which employs 7-azaindole and related compounds; Maskasky and Chang U.S. Pat. No. 5,178,998, which employs xanthine and related compounds; Maskasky U.S. Pat. No. 5,183,732 (hereinafter designated Maskasky IV), which employs adenine; and Maskasky U.S. Pat. No. 5,185,239 (hereinafter designated Maskasky V), which employs specified 4,5,6-triaminopyrimidine and related compounds.

With many alternative choices of grain growth modifiers available, some of which can produce thin (<0.2 μm) high chloride tabular grains or, in a few instances, ultrathin (<0.07 μm) high chloride tabular grains, the problem of being able to prepare high chloride tabular grain emulsions has been largely addressed.

The remaining problem is to increase the sensitivity of high chloride tabular grain emulsions to levels more comparable to those of silver iodobromide tabular grain emulsions.

It is known that forming within a silver halide grain structure a junction of two significantly different halide compositions produces crystal lattice strains and/or disruptions that are capable of increasing photographic sensitivity. Maskasky U.S. Pat. No. 4,435,501 (hereinafter Maskasky VI) discloses large sensitivity enhancements when silver chloride is epitaxially deposited on silver bromide and silver iodobromide tabular grains. Maskasky VI also reports in Example 20 deposition of AgSCN epitaxy on silver chloride tabular grains. The silver salt epitaxy precipitated by Maskasky, regardless of its composition or that of the host tabular grain on which its deposited, is in all instances clearly nontabular in form, typically taking the form of nontabular edge or corner protrusions. Kofron et al U.S. Pat. No. 4,439,520 suggests creating high aspect ratio tabular grains with core-shell structures. Evans et al U.S. Pat. No. 4,504,570 discloses preparing core-shell tabular grains capable of forming an internal latent image. Takada et al, cited above, discloses the addition of from 0.01 to 10, preferably 0.1 to 3 mole % bromide to the surface of high chloride tabular grains. Houle et al U.S. Pat. No. 5,035,992, which employs the tabular grain growth modifiers disclosed by Tufano et al, cited above, teaches a process for stabilizing high chloride tabular grains by the graded increase of bromide concentrations at the conclusion of precipitation.

Figure 2:
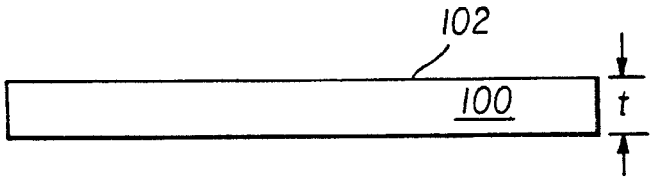
FIG. 2 is a sectional view of the tabular grain of FIG. 1.
Figure 3:
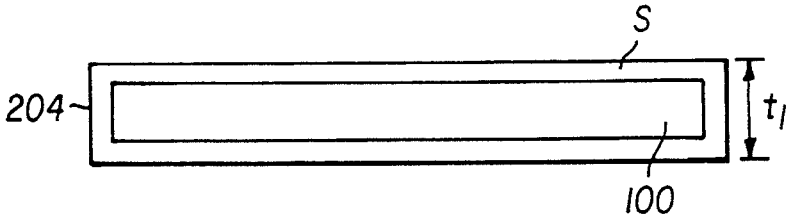
FIG. 3 is a sectional view of the tabular grain of FIGS. 1 and 2 with conventional shelling.

The problem of resorting to shelling to improve the performance of high chloride tabular grains is illustrated FIGS. 1 to 3. In FIGS. 1 and 2 a high chloride tabular grain 100 is shown. The upper major face 102 of the tabular grain is large compared to its thickness t. It is the large upper major face available to capture exposing radiation and the limited thickness of the tabular grain that provide the advantages of this grain shape.

If a conventional shelling procedure is followed, the grain structure shown in FIG. 3 results. Although the shell S produces a layer of uniform thickness on all external surfaces of the grain 100, the additional silver halide precipitated to form the shell is located primarily on the major faces of the original tabular grains. Only a very small fraction of the additionally deposited silver halide is located on the edges of the tabular grain 100, since the edge surface area of the tabular grain 100 is small compared the surface area of the major faces. The shell increases the projected area of the tabular grain available to capture exposing radiation only slightly. This is shown by comparing the location of the peripheral edge 204 of the shelled grain to that of tabular grain 100 in FIG. 1. However, the thickness $t_1$ of the shelled tabular grain shows a high percentage increase when compared to the thickness t of tabular 100.

Stated another way, conventional shelling procedures degrade desirable tabular grain properties. Tabular grain projected area is increased little, while tabular grain aspect ratio is reduced significantly and tabular grain thickness is increased significantly.

Maskasky U.S. Pat. No. 5,411,851, discloses a process for the preparation of an ultrathin (<0.07 μm) high (>50 mole %) bromide tabular grain emulsion by employing a triaminopyrimidine grain growth modifier containing mutually independent 4, 5 and 6 ring position amino substituents, the 4 and 6 ring position substituents being hydroamino substituents.

Maskasky U.S. Pat. No. 5,411,852, discloses a process of preparing a high chloride tabular grain emulsion by employing as a grain growth modifier a phenol having at least two iodo substituents.

Maskasky U.S. Pat. No. 5,399,478 discloses a process of preparing a high chloride tabular grain emulsion by employing as a grain growth modifier an iodo-substituted quinoline.

Maskasky U.S. Pat. No. 5,418,125, discloses a process for the preparation of an ultrathin high bromide tabular grain emulsion by employing an 8-iodo substituted quinoline grain growth modifier.

RELATED PATENT APPLICATIONS

Maskasky U.S. Ser. No. 394,984, filed concurrently, titled TABULARLY BANDED EMULSIONS WITH HIGH BROMIDE CENTRAL PORTIONS, commonly assigned, discloses high bromide tabular grain emulsions in which the tabular grains contain a peripheral tabular band containing a lower proportion of bromide, typically a high chloride tabular band.

Maskasky U.S. Ser. No. 394,988, filed concurrently, titled EMULSIONS WITH TABULAR GRAIN MAJOR FACES FORMED BY REGIONS OF DIFFERING IODIDE CONCENTRATIONS, commonly assigned, discloses high bromide tabular grain emulsions in which a portion of the {111} major faces is formed by a central region containing at least 7 mole percent iodide and an annular band extends outwardly from the central region forming a second portion of the {111} major faces and contains less than half the iodide of the central region.

SUMMARY OF THE INVENTION

The present invention provides an emulsion with tabular grains that combine the performance advantages of high chloride with those of providing an internal interface with a significantly different silver halide composition while at the same time enhancing performance characteristics attributable to tabular grain geometry by increasing tabular grain projected area without a concomitant increase in tabular grain thickness. In fact, significant increases in tabular grain projected area have been achieved without any measurable increase in tabular grain thickness.

In one aspect this invention is directed to a radiation-sensitive emulsion comprised of a dispersing medium and silver halide grains, at least 50 percent of total grain projected area being accounted for by tabular grains of a face centered cubic crystal lattice structure having parallel {111} major faces and an average aspect ratio of at least 5, the tabular grains each being comprised of a central region and a shell differing in halide content, wherein the central region contains greater than 50 mole percent chloride, the shell contains less than 40 mole percent chloride, and the shell is comprised of a band extending laterally outwardly from the central region and forming at least 25 percent of the {111} major faces, the band accounting for at least half the volume of the shell.

DESCRIPTION OF PREFERRED EMBODIMENTS

Figure 4:
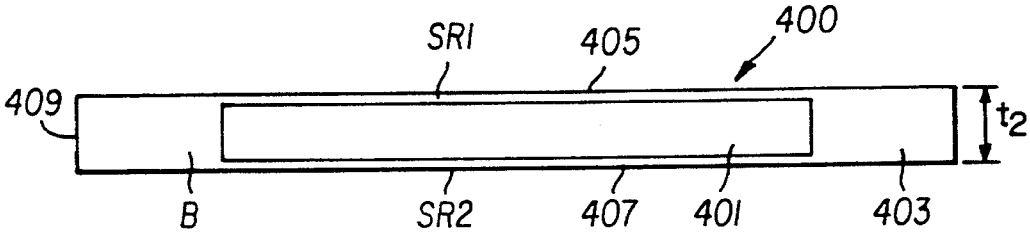
FIG. 4 is a sectional view of the tabular grain of FIGS. 1 and 2 with a shell according to the invention.

The FIG. 4 a tabular grain 400 is shown that illustrates the unique features of the emulsions of this invention. A central region 401 of the grain can be and is, as shown, identical to a conventional high chloride tabular grain 100.

Surrounding the central region is a shell 403. The shell forms the major {111} crystal faces 405 and 407 of the tabular grain. The shell 403 differs from conventional shell S in that at least half of the volume of the shell is located in a band B extending laterally outwardly from the central region and forming at least 25 percent of the major {111} crystal faces of the tabular grain. The remainder of the shell consists of surface regions SR1 and SR2 that are interposed between the surface region and the major {111} crystal faces 405 and 407, respectively.

Although the surface regions SR1 and SR2 are shown thinner than the corresponding surface regions of the conventional shell S, which contains the same total amount of silver halide, the thickness of the surface regions SR1 and SR2 has been exaggerated for ease of visualization. In fact, in the preferred embodiments of the invention, demonstrated in the Examples below, the surface regions of the shell contain such small amounts of silver halide that they have not been detected.

There are two significant effects of disproportionately locating the silver halide forming the shell 403 in the band B, both beneficial. First, the amount of silver halide contained in the surface regions SR1 and SR2 of the shell is minimized, thereby minimizing increase in the thickness of the tabular grain. Note that the thickness $t_1$ of the shelled tabular grain in FIG. 3 is significantly greater than the thickness of the thickness $t_2$ of tabular grain 400.

Second, by directing at least half of the silver halide to the band B, the projected area of the tabular grain 400 is significantly increased as compared to the conventional shell tabular grain shown in FIG. 3. This is illustrated by comparing in FIG. 1 the location of peripheral edge 409 of tabular grain 400 with the peripheral edge 204 of the conventionally shelled grain. The increase of the projected area of the tabular grain increases its ability of intercept and absorb exposing radiation.

An important feature of the invention is that the portion of the shell forming the band B is itself tabular in character, unlike conventional shells that are nontabular overgrowths on tabular grains. The formation of tabular bands has been achieved by the discovery of heretofore unrealized conditions for tabular grain preparation, described in detail and demonstrated below.

The radiation-sensitive emulsions of the invention are comprised of tabular grains accounting for at least 50 percent of total grain projected area having structural features of the type described for grain 400. Preferably these tabular grains account for at least 70 percent of total grain projected area and optimally at least 90 percent of total grain projected area. These tabular grains have an average aspect ratio of at least 5, preferably >8. Since the tabular grains are actually increased in aspect ratio by shelling according to the teachings of the invention, the tabular grain emulsions of the invention can have average aspect ratios equaling or exceeding the highest average aspect ratios reported for high chloride tabular grain emulsions.

The central regions of the tabular grains of this invention can correspond to conventional high chloride tabular grains, which provide convenient starting materials for the formation of the tabular grain emulsions of the invention. Conventional high chloride tabular grain emulsions that can be employed to provide the central regions of the grains of this invention are illustrated by the following, the disclosures of which are incorporated by reference:

Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,491;
Ishiguro et al U.S. Pat. No. 4,983,508;
Tufano et al U.S. Pat. No. 4,804,621;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858;
Chang et al U.S. Pat. No. 5,252,452;
Maskasky U.S. Pat. No. 5,298,387 and
Maskasky U.S. Pat. No. 5,298,388.

The high chloride tabular grain emulsions employed to prepare the central regions of the tabular grains of the invention contain at least 50 mole percent, preferably at least 70 mole percent and optimally at least 90 mole percent chloride, based on total silver. It is specifically contemplated to employ emulsions as starting materials that consist essentially of silver chloride. Minor amounts of other halides can be present. Silver bromide and silver chloride are compatible in all ratios in the face centered cubic crystal lattice structure that forms the grains. Thus, silver bromide can be present in the high chloride tabular grains and in the central regions of the tabular grains of the invention in concentrations of up to 50 mole percent, based on silver. Silver iodide does not alone form a face centered cubic crystal lattice structure under conditions relevant to photographic emulsion preparation. Silver iodide can under ordinary precipitation conditions be tolerated in the face centered cubic crystal lattice structure of silver bromide in concentrations of up to approximately 40 mole percent. Silver iodide can be tolerated in the face centered cubic crystal lattice structure of silver chloride under ordinary precipitation conditions in concentrations of up to approximately 13 mole percent. Maskasky U.S. Pat. No. 5,238,804 and 5,288,603 disclose elevated temperature precipitation techniques for increasing maximum iodide incorporation levels. It is contemplated that silver iodide can be present in the high chloride tabular grains forming the central regions up to its saturation level in the face centered cubic crystal lattice structure. However, for ease of emulsion preparation, it is generally preferred to limit iodide concentrations in the high chloride tabular grains forming the central regions to 8 mole percent or less.

The high chloride tabular grain emulsions used to provide the central regions of the tabular grain emulsions of the invention can have any average aspect ratio compatible with achieving an average aspect ratio of at least 5 in the final emulsion. Since the band structure added disproportionately increases tabular grain ECD as compared to tabular grain thickness, the starting emulsion can have an average aspect ratio somewhat less than 5, but the aspect ratio is preferably at least 5. The starting emulsion can have any convenient conventional higher average aspect ratio, such as any average aspect ratio reported in the patents cited above.

The average thickness of the high chloride tabular grains employed to form the central regions can take any value compatible with achieving the required final average aspect ratio of at least 5. It is generally preferred that the thickness of the grains forming the central region be less than 0.3 μm. Thin tabular grain emulsions, those having an average thickness of less than 0.2 μm, are preferred. It is specifically contemplated to employ as starting materials ultrathin tabular grain emulsions—i.e., those having an average tabular grain thickness of <0.07 μm.

The high chloride tabular grain emulsions employed as starting materials must have tabular grain projected areas sufficient to allow the tabular grains in the final emulsion to account for at least 50 percent of total grain projected area. Since band formation increases the tabular grain projected area by at least 25 percent, it is appreciated that the initial tabular grain projected can be significantly less than 50 percent. However, the preferred starting materials are those that contain tabular grain projected areas of at least 50 percent, preferably at least 70 percent and optimally at least 90 percent. Generally, the exclusion of nontabular grains to the extent conveniently attainable is preferred.

Although silver bromide readily forms tabular grain emulsions under selected precipitation conditions, the addition of soluble silver and bromide salts or preformed Lippmann silver bromide grains to a dispersing medium under conditions known to form silver bromide tabular grains does not achieve this result when the dispersing medium already contains a silver chloride tabular grain population. Instead of forming tabular grains, small amounts of silver bromide deposit onto the silver chloride grains resulting in uniform shelling that exhibits a halide composition highly enriched in silver chloride. Higher amounts of silver bromide deposition results in the destruction of the tabular characteristics of the host silver chloride grains. If a site director is employed, as taught by Maskasky U.S. Pat. No. 4,435,501, the additional silver halide is deposited non-uniformly, but in the form of nontabular epitaxial deposits concentrated at the corners and/or edges of the grains.

It has been discovered quite unexpectedly that a few of the many known grain growth modifiers that produce high chloride tabular grains can be used to produce a shell structure on a pre-existing high chloride tabular grain population, where the shell structure itself retains tabular grain precipitation characteristics. That is, as the shell is formed silver halide is deposited preferentially onto the peripheral edges of the host high chloride tabular grains and precipitation onto the major faces of the high chloride tabular grains is disproportionately limited. In fact, in preferred embodiments of the invention, precipitation onto the major faces of the pre-existing tabular grains is such that it has not been possible to detect its presence.

The following conventional grain growth modifiers have not been found to be useful in achieving shell band formation satisfying the requirements of the invention: adenine, xanthine and 4-aminopyrazolo[3,4-d]pyrimidine. Grain growth modifiers of these types are disclosed in Maskasky U.S. Pat. Nos. 4,400,463, 4,713,323 and 5,183,732, Maskasky and Chang U.S. Pat. No. 5,178,998, Tufano et al U.S. Pat. No. 4,804,621 and Houle et al U.S. Pat. No. 5,035,992.

Grain growth modifiers of the 4,5,6-triaminopyrimidine type have been observed to be useful in growing tabular bands on high chloride tabular grain emulsions. These grain growth modifiers satisfy the following formula:

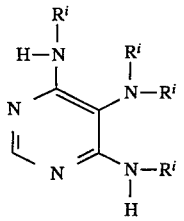

(I)

where $R^i$ is independently in each occurrence hydrogen or a monovalent hydrocarbon group of from 1 to 7 carbon atoms of the type indicated above, preferably alkyl of from 1 to 6 carbon atoms.

The following are illustrations of varied 4,6-di(hydroamino)-5-aminopyrimidine compounds within the purview of the invention:

4,5,6-Triaminopyrimidine PY-1

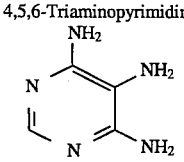

5,6-Diamino-4-(N-methylamino)pyrimidine PY-2

-continued

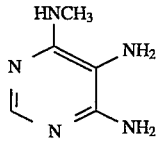

4,5,6-Tri(N-methylamino)pyrimidine PY-3

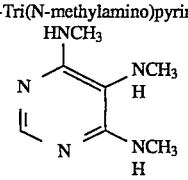

4,6-Diamino-5-(N,N-dimethylamino)pyrimidine PY-4

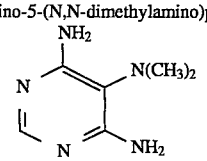

4,6-Diamino-5-(N-hexylamino)pyrimidine PY-5

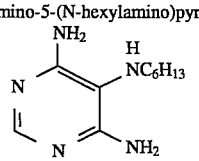

Starting with a conventional high chloride tabular grain emulsion of the type described above an aqueous dispersion is prepared containing at least 0.1 percent by weight silver, based on total weight, in the form of grains supplied by the starting emulsion. The weight of silver in the dispersing medium can range up to 20 percent by weight, based on total weight, but is preferably in the range of from 0.5 to 10 percent by weight, based on the total weight of the dispersion.

The aqueous dispersion also receives the water and peptizer that are present with the high chloride tabular grains in the starting emulsion. The peptizer typically constitutes from about 1 to 6 percent by weight, based on the total weight of the aqueous dispersion. In the simplest mode of practicing the invention, the tabular band growth process of the invention is undertaken promptly upon completing precipitation of the high chloride tabular grain emulsion, and only minimum required adjustments of the dispersing medium of the starting emulsion are undertaken to satisfy the aqueous dispersion requirements of the tabular band growth process. Intermediate steps, such as washing, prior to commencing the tabular band growth process are not precluded.

The pH of the aqueous dispersion employed in the tabular band growth process is in the range of from 4.6 to 9.0, preferably 5.0 to 8.0. Adjustment of pH, if required, can be undertaken using a strong mineral base, such as an alkali hydroxide, or a strong mineral acid, such as nitric acid or sulfuric acid. If the pH is adjusted to the basic side of neutrality, the use of ammonium hydroxide should be avoided, since under alkaline conditions the ammonium ion acts as a ripening agent and will increase grain thickness.

To minimize the risk of elevated minimum densities in the emulsions prepared, it is common practice to prepare photographic emulsions with a slight stoichiometric excess of bromide ion present. At equilibrium the following relationship exists:

$$-\log K_{sp}=pBr+pAg \quad (I)$$

where $K_{sp}$ is the solubility product constant of silver bromide;

pBr is the negative logarithm of bromide ion activity; and pAg is the negative logarithm of silver ion activity.

The solubility product constant of silver bromide emulsions in the temperature range of from 0° to 100° C. has been published by Mees and James The Theory of the Photographic Process, 3th Ed., Macmillan, New York, 1966, page 6. The equivalence point, pBr=pAg=−log $K_{sp}$÷2, which is the point at which no stoichiometric excess of bromide ion is present in the aqueous dispersion, is known from the solubility product constant. By employing a reference electrode and a sensing electrode, such as a silver ion or bromide ion sensing electrode or both, it is possible to determine from the potential measurement of the aqueous dispersion its bromide ion content (pBr). Lin et al U.S. Pat. No. 5,317,521, is here incorporated by reference to show electrode selections and techniques for monitoring pBr. To avoid unnecessarily high bromide ion concentrations in the aqueous dispersion (and hence unnecessary waste of materials) the pBr of the aqueous dispersion is adjusted to at least 1.5, preferably at least 2.0 and optimally greater than 2.6. Soluble bromide salt (e.g. alkali bromide) addition can be used to decrease pBr while soluble silver salt (e.g. silver nitrate) additions can be used to increase pBr.

The triaminopyrimidine grain growth modifier is added to the aqueous dispersion, either before, during or following the pBr and pH adjustments indicated.

One of the surprising discoveries has been that grain growth modifiers that function similarly as the triaminopyrimidines of the invention when employed in the preparation of high chloride {111} tabular grain emulsions are not effective when substituted for the grain growth modifiers of the invention in the tabular band growth process.

It is believed that the effectiveness of the grain growth modifier to produce tabular bands is attributable to its preferential absorption to {111} crystal faces and its ability to preclude additional silver halide deposition on these surfaces. This explanation does not, however, explain the failure of other grain growth modifiers that are also believed to perform the same function. Actual observations indicate that the interactions between the various grain surfaces present in the aqueous dispersion and the grain growth modifier are, in fact, complex. Why one type of grain growth modifier is useful to prepare tabular bands while another has not been explained.

Contemplated concentrations of the grain growth modifier for use in the tabular band growth process are from 0.1 to 500 millimoles per silver mole. A preferred grain growth modifier concentration is from 0.4 to 200 millimoles per silver mole, and an optimum grain growth modifier concentration is from 4 to 100 millimoles per silver mole.

Once the grain growth modifier has been introduced into the aqueous dispersion, tabular bands are grown on the high chloride tabular grains by providing the silver and bromide ions required to form the shell and holding the aqueous dispersion at any convenient temperature known to be compatible with grain ripening. This can range from about room temperature (e.g., 15° C.) up to the highest temperatures conveniently employed in silver halide emulsion preparation, typically up to about 90° C. A preferred holding temperature is in the range of from about 20° to 80° C., optimally from 35° to 70° C.

The holding period will vary widely, depending upon the starting grain population, the temperature of holding and the objective sought to be obtained. For example, starting with a high chloride tabular grain emulsion to provide the starting grain population with the objective of increasing mean ECD by a minimum 0.1 μm, a holding period of no more than a few minutes may be necessary in the 30° to 60° C. temperature range, with even shorter holding times being feasible at increased holding temperatures. On the other hand, if the starting grains are intended to form a minimal proportion of the final grain structure, holding periods can range from few minutes at the highest contemplated holding temperatures to overnight (16 to 24 hours) at ambient temperatures. The holding period is generally comparable to run times employed in preparing high bromide tabular grain emulsions by double jet precipitation techniques when the temperatures employed are similar. The holding period can be shortened by the introduction into the aqueous dispersion of a ripening agent of a type known to be compatible with obtaining thin (less than 0.2 μm mean grain thickness) tabular grain emulsions, such as thiocyanate or thioether ripening agents.

Grain growth modifiers of the iodo-8-hydroxyquinoline type have also been observed to be useful in growing tabular bands on high chloride tabular grain emulsions. The required iodo substituent can occupy any synthetically convenient ring position of the 8-hydroxyquinolines. When the 8-hydroxyquinoline ring is not otherwise substituted, the most active sites for introduction of a single iodo substituent are the 5 and 7 ring positions, with the 7 ring position being the preferred substitution site. Thus, when the 8-hydroxyquinoline contains two iodo substituents, they are typically located at the 5 and 7 ring positions. When the 5 and 7 ring positions have been previously substituted, iodo substitution can take place at other ring positions.

Further ring substitutions are not required, but can occur at any of the remaining ring positions. Strongly electron withdrawing substituents, such as other halides, pseudohalides (e.g., cyano, thiocyanato, isocyanato, etc.), carboxy (including the free acid, its salt or an ester), sulfo (including the free acid, its salt or an ester), α-haloalkyl, and the like, and mildly electron withdrawing or electron donating substituents, such as alkyl, alkoxy, aryl and the like, are common at a variety of ring positions on both of the fused rings of the 8-hydroxyquinolines.

Polar substituents, such as the carboxy and sulfo groups, can perform the advantageous function of increasing the solubility of the iodo-substituted 8-hydroxyquinoline in the aqueous dispersing media employed for emulsion precipitation.

In one specifically preferred form the iodo-8-hydroxyquinolines satisfy the following formula:

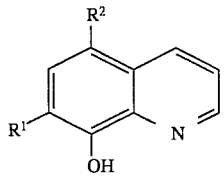

(II)

where $R^1$ and $R^2$ are chosen from among hydrogen, polar substituents, particularly carboxy and sulfo substituents, and strongly electron withdrawing substituents, particularly halo and pseudohalo substituents, with the proviso that at least one of $R^1$ and $R^2$ is iodo.

The following constitute specific illustrations of iodo-substituted 8-hydroxyquinoline grain growth modifiers contemplated for use in the practice of the invention:

IHQ-1 5-Chloro-8-hydroxy-7-iodoquinoline

IHQ-2 8-Hydroxy-7-iodo-2-methylquinoline

IHQ-3 4-Ethyl-8-hydroxy-7-iodoquinoline

IHQ-4 5-Bromo-8-hydroxy-7-iodoquinoline

IHQ-5 5,7-Diiodo-8-hydroxyquinoline
IHQ-6 8-Hydroxy-7-iodo-5-quinolinesulfonic acid
IHQ-7 8-Hydroxy-7-iodo-5-quinolinecarboxylic acid
IHQ-8 8-Hydroxy-7-iodo-5-iodomethylquinoline
IHQ-9 8-Hydroxy-7-iodo-5-trichloromethylquinoline
IHQ-10 α-(8-Hydroxy-7-iodoquinoline)acetic acid
IHQ-11 7-Cyano-8-hydroxy-5-iodoquinoline
IHQ-12 8-Hydroxy-7-iodo-5-isocyanatoquinoline Grain growth modifiers of the polyiodophenol type have additionally been observed to be useful in growing tabular bands on high chloride tabular grain emulsions. Polyiodophenols are arylhydroxides containing two or more iodo substituents.

In one simple form the phenol can be a hydroxy benzene containing at least two iodo substituents. It is synthetically most convenient to place the iodide substituents in at least two of the 2, 4 and ring positions. When the benzene ring is substituted with only the one hydroxy group and iodo moieties, all of the possible combinations are useful as grain growth modifiers in the practice of the invention.

The hydroxy benzene with two or more iodo substituents remains a useful grain growth modifier when additional substituents are added, provided none of the additional substituents convert the compound to a reducing agent. Specifically, to be useful in the practice of the invention the phenol with two or more iodo substituents must be incapable of reducing silver chloride under the conditions of precipitation. Silver chloride is the most easily reduced of the photographic silver halides; thus, if a compound will not reduce silver chloride, it will not reduce any photographic silver halide. The reason for excluding compounds that are silver chloride reducing agents is that reduction of silver chloride as it is being precipitated creates Ag that produces photographic fog on processing.

Fortunately, phenols that are capable of reducing silver chloride are well known to the art, having been extensively studied for use as developing agents. For example, hydroquinones and catechols are well known developing agents as well as p-aminophenols. Thus, those skilled in the art through years of extensive investigation of developing agents have already determined which phenols are and are not capable of reducing silver chloride. According to James *The Theory of the Photographic Process,* 4th Ed., Macmillan, New York, 1977, Chapter 11, D. Classical Organic Developing Agents, 1. RELATION BETWEEN DEVELOPING ACTION AND CHEMICAL STRUCTURE, compounds that satisfy the following structure are developing agents:

$$a-(\overset{|}{C}=\overset{|}{C})_n-a'$$

where, in the case of a phenol, a is hydroxy, a' is hydroxy or amino (including primary, secondary or tertiary amino), and n=1, 2 or 4.

From the foregoing it is apparent that the overwhelming majority of phenol substituents in addition to the required hydroxy and iodo substituents are incapable of rendering the phenols reducing agents for silver chloride. Such additional substituents, hereinafter referred to as photographically inactive substituents, include, but are not limited to, the following common classes of substituents for phenols: alkyl, cycloalkyl, alkenyl (e.g., allyl), alkoxy, aminoalkyl, aryl, aryloxy, acyl, halo (i.e., F, Cl or Br), nitro ($NO_2$), and carboxy or sulfo (including the free acid, salt or ester). All aliphatic moieties of the above substituents preferably contain from 1 to 6 carbon atoms while all aryl moieties preferably contain from 6 to 10 carbon atoms. When the phenol contains two iodo substituents and an additional, photographically inactive substituent, the latter is preferably located para to the hydroxy group on the benzene ring.

It has been demonstrated that phenols contain two or three iodo substituents are highly effective as grain growth modifiers, but that phenols with a single iodo substituent are ineffective. This was not predicted and is, in fact, quite unexpected.

There are, of course, many varied phenols known to the art that are available for selection as grain growth modifiers in the practice of the invention. The following are specific illustrations of polyiodophenol grain growth modifiers contemplated for use in the practice of the invention:

2,6-diiodophenol PIP-1

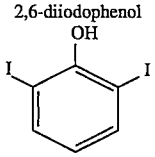

2,4,6-triiodophenol PIP-2

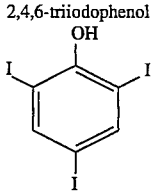

2,6-diiodo-4-nitrophenol PIP-3

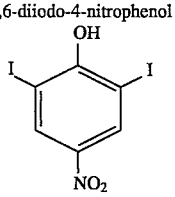

2,6-diiodo-4-methylphenol PIP-4

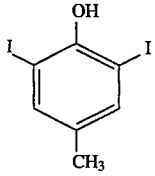

4-allyl-2,6-diiodophenol PIP-5

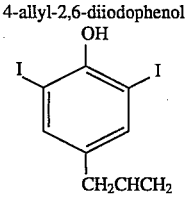

4-cyclohexyl-2,6-diiodophenol PIP-6

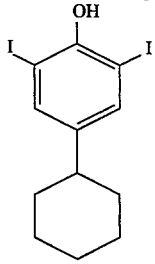

2,6-diiodo-4-phenylphenol PIP-7

-continued

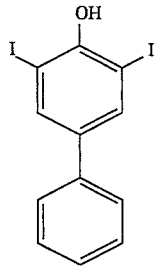

4,6-diiodo-2-acetophenone

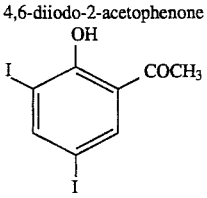

4,6-diiodothymol

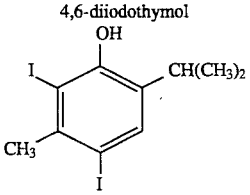

4,6-diiodocarvacrol

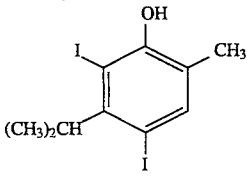

3,5-diiodo-L-tyrosine

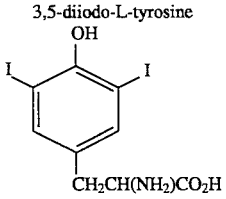

3',3",5',5"-tetraiodophenolphthalein

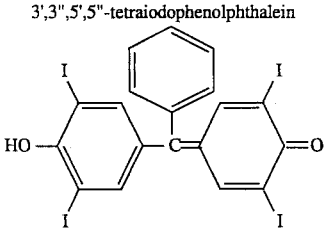

erythrosin

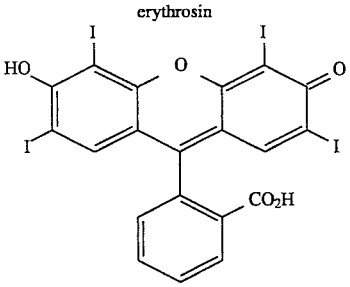

rose bengal

-continued

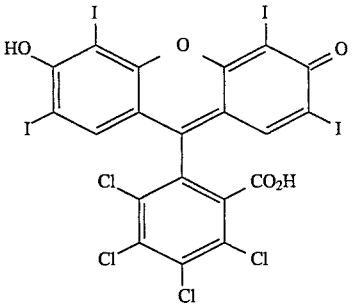

PIP-8

The procedures for using the iodo-8-hydroxyquinoline and polyiodophenol grain growth modifiers are similar to those described in detail for using the 4,5,6-triaminopyrimidine grain growth modifiers, except for the following differences: When an iodo-8-hydroxyquinoline grain growth modifier is employed, the pH of the dispersing medium can range from 2 to 8, preferably from 3 to 7. When a polyiodophenol grain growth modifier is employed, the pH of the dispersing medium can range from 1.5 to 10, preferably from 2 to 7. When an iodo-8-hydroxyquinoline or polyiodophenol grain growth modifier is employed, the ripening temperature is preferably at least 40° C.

PIP-9

The tabular band can be formed of any silver halide composition that forms a face centered cubic crystal lattice structure, but is limited to halide compositions that contain less than 40 mole percent chloride for the purpose of creating a difference in halide compositions between the central region and the shell. The shell preferably contains at least 50 mole percent bromide, most preferably at least 70 mole percent bromide. Minor amounts of iodide, up to the solubility limit of iodide, can be incorporated during shell formation. Even when no chloride is added to the dispersing medium during shell growth minor amounts of chloride can still be present, since some degree of halide migration between the central region and the shell can be expected to occur during tabular band growth.

PIP-10

The division of total silver between the central region and the shell can vary widely. As little as 5 percent of the total silver in a completed emulsion can be located in the central grain regions, while the balance of the silver is located in the shell. It is generally preferred that the central regions on average account for at least 10 percent, most preferably at least 25 percent of the total silver forming the shelled tabular grains.

PIP-11

A distinctive and highly advantageous feature of the emulsions of the invention is that a disproportionately large fraction of the total silver forming the shell is contained in a tabular band laterally surrounding the central region and forming a large fraction of the {111} major faces of the tabular grains. Maximizing the growth of the tabular band while minimizing thickness growth of the tabular grains during shelling improves the aspect ratios of the tabular grains. The tabular band accounts for at least half of the silver forming the shell. Preferably the tabular band accounts for at least 70 percent of the total silver forming the shell, most preferably at least 80 percent. In emulsion preparations reported in the Examples below tabular grain emulsions according to the invention have been prepared in which portions of the shell overlying the major faces of the central regions have not been detected. Thus, for all practical purposes the tabular band constitutes the entire shell in these instances.

PIP-12

PIP-13

PIP-14

The proportion of total grain projected area increases as the percentage of total silver accounted for by the shell increases and as the percentage of shell silver accounted for by the tabular bands increases. It is specifically contemplated to form tabular grains according to the invention in which the tabular bands account for as much as 95 percent of total grain projected area. Different choices halide compositions in the shell and central region as well as different photographic applications can dictate different ratios, but it is generally preferred that the tabular shells account for at least 50 percent of total grain projected area.

Apart from the features that have been specifically disclosed, the emulsions of the invention, their preparation and photographic elements containing these emulsions can take any convenient conventional form. Conventional features are illustrated by *Research Disclosure,* Vol. 365, September 1994, Item 36544.

EXAMPLES

The invention can be better appreciated by reference to the following specific examples.

Emulsion A Preparation of AgCl Tabular Grain Starting Emulsion Using 4,5,6-Triaminopyrimidine Grain Growth Modifier To a vigorously stirred reaction vessel containing 2 L of a solution at pH 6.0 and at 40° C. that was 2% in bone gelatin, 1.6 mM in 4,5,6-triaminopyrimidine, 0.040M in NaCl, and 0.20M in sodium acetate were added 4M $AgNO_3$ solution and 4.5M NaCl solution. The $AgNO_3$ solution was added at 1.3 mL/min for 1 min then its flow rate was linearly accelerated to 23.4 mL/min during a period of 28 min to deliver a total of 1.34 mole of silver. The 4.5M NaCl solution was added at a rate needed to maintain a constant pCl of 1.40. The pH was held constant at 6.0±0.1 during the precipitation.

The resulting emulsion consisted of an AgCl tabular grain population having an average ECD of 2.0 μm, an average thickness of 0.08 μm, and an average aspect ratio of 25. The tabular grains accounted for approximately 80% of the total projected area of the emulsion grains.

Emulsion B Fine Grain AgIBr (1 mole % I) Emulsion

To a vigorously stirred reaction vessel containing 50 g gelatin (~50 μmole methionine per gram gelatin) and 2 L distilled water at 25° C. was added 300 mL of 2M $AgNO_3$ solution at a rate of 300 mL per min using two pumps and a 12-hole ring outlet. A 2M NaBr, 0.02M KI solution was simultaneously added at a rate needed to maintain a pBr of 3.82 using two pumps and a 12-hole ring outlet. The silver and halide introducing ring outlets were mounted above and below a rotated stirring head, respectively.

Emulsion C Fine Grain AgIBr (12 mole % I) Emulsion

This emulsion was prepared similarly to that of Emulsion B, except that the 2M NaBr, 0.02M KI solution was replaced by a 1.76M NaBr, 0.24M KI solution.

Emulsion D Fine Grain AgBr Emulsion

To a stirred reaction vessel containing 2 L of 5 wt % gelatin at 35° C. were added 2M $AgNO_3$ solution and 2M NaBr solution. The $AgNO_3$ solution was added at 300 mL/min and the NaBr solution was added as needed to maintain a pBr of 3.63. A total of 0.6 mole of $AgNO_3$ was added.

Emulsion E AgBr Tabular Grain Core Emulsion

To a stirred reaction vessel containing 7.5 g of oxidized gelatin, 1.39 g NaBr, and distilled water to 2 L at 35° C. and pH 2.0, 10 mL of 2M $AgNO_3$ solution were added at 50 mL/min. Concurrently, 2M NaBr solution was added to maintain a pBr of 2.21. The temperature was increased to 60° C. at a rate of 5° C./3 min then 150 mL of a 33% oxidized gelatin solution at 60° C. was added, the pH was adjusted to 6.0, and 14 mL of a 2M NaBr solution was added. At 60° C. and pH 6.0, 500 mL of a 2M $AgNO_3$ solution were added at 20 mL/min. Concurrently, 2M NaBr solution was added to maintain a pBr of 1.76.

The resulting tabular grains were 1.3 μm in ECD and 0.04 μm in thickness.

Example 1

Growing 1 mole % I High Bromide Annular Band onto AgCl Tabular Grains Using 12 mmole per Ag mole of 4,5,6-Triaminopyrimidine.

To 13.9 mmole of Emulsion B at 25° C. was added 4 mL of an aqueous solution containing 0.30 mmole of 4,5,6-triaminopyrimidine. The temperature was raised to 40° C., the pH was adjusted to 6.0 and the pBr to 3.39. Then 13.9 mmole of Emulsion A was added and the pH was readjusted to 6.0. The mixture was stirred for 30 min at 40° C.

The resulting emulsion was comprised of a tabular grain population having an average ECD of 2.8 μm, an average thickness of 0.08 μm, and an average aspect ratio of 35. This tabular grain population made up approximately 80% of the total projected area of the emulsion grains. The results are given in Table I. Low temperature (77° K.) luminescence microscopy of the emulsion grains using a UV to 515 nm blocking filter showed bright green annular bands that are the AgIBr concentrated areas. The low temperature luminescence microscope is described in Maskasky, J. Imaging Sci. Vol. 32 (1988) pg. 15.

X-ray powder diffraction data showed that 3 phases were present. One phase (the core) was 100 mole % AgCl; a minor phase was 53 mole % AgCl; and the third phase was 74 mole % AgBr. Energy Dispersive Spectroscopy composition analysis showed that a plug through the central region of grains consisted of 98–99 mole % AgCl and 2–1 mole % AgBr and through the annular region consisted of 68–72 mole % AgBr 32–28 mole % AgCl.

Example 2

Growing 1 mole % I High Bromide Annular Band onto AgCl Tabular Grains Using 1.0 mmole per Ag mole of 2,4,6,-Triiodophenol and 1.2 mmole per Ag mole of 4,5,6-Triaminopyrimidine.

This example was prepared similarly to that of Example 1, except that instead of adding 4,5,6-triaminopyrimidine, 1 mL of a methanol solution containing 0.028 mmole of 2,4,6-triiodophenol was added.

The resulting emulsion was comprised of tabular grains having an average ECD of 2.8 μm, an average thickness of 0.08 μm, and an average aspect ratio of 35. The tabular grains accounted for approximately 80% of the total projected area of the emulsion grains. The results are given in Table I.

Example 3

Growing 1 mole % I High Bromide Annular Band onto AgCl Tabular Grains Using 2.0 mmole per Ag mole of 2,4,6-Triiodophenol and 1.2 mmole per Ag mole of 4,5,6-Triaminopyrimidine.

This example was prepared similarly to that of Example 1, except that instead of adding 4,5,6-triaminopyrimidine, 2 mL of a methanol solution containing 0.056 mmole of 2,4,6-triiodophenol was added and the mixture was heated at 40° C. for 4 hrs.

The resulting emulsion was comprised of tabular gains having an average ECD of 2.8 μm, an average thickness of 0.08 μm, and an average aspect ratio of 35. The tabular grains accounted for approximately 80% of the total projected area of the emulsion grains. The results are given in Table I. Low temperature (77° K.) luminescence microscopy of the emulsion grains using a UV to 515 nm blocking filter showed bright green annular bands that are the AgIBr regions.

Control Example 4

Attempt to Grow 1 mole % I High Bromide Annular Band onto AgCl Tabular Grains Using the 1.2 mole per Ag mole of 4,5,6-Triaminopyrimidine That Was Present in the AgCl Core Emulsion This example was prepared similarly to that of Example 1, except that no 4,5,6-triaminopyrimidine was added. The mixture contained only the 4,5,6-triaminopyrimidine that was present in Emulsion A The resulting emulsion was comprised of tabular gains having an average ECD of 2.1 μm, an average thickness of 0.13 mm, and an average aspect ratio of 16. The tabular grains accounted for approximately 65% of the total projected area of the emulsion grains. The calculated volume of the band was only 21 percent of the total volume of the shell, see Table I.

Example 5

Growing 12 mole % I High Bromide Annular Band onto AgCl Tabular Grains.

To 13.9 mmole of Emulsion C at 25° C. was added 2 mL of an aqueous solution containing 0.15 mmole of 4,5,6-triaminopyrimidine. The temperature was raised to 40° C., the pH was adjusted to 6.0 and the pBr to 3.39. Then 20.9 mmole of Emulsion A was added and the pH was readjusted to 6.0. The mixture was stirred for 30 min at 40° C.

The resulting emulsion was comprised of a tabular grain population having an average ECD of 2.5 μm, an average thickness of 0.085 μm, and an average aspect ratio of 29. This tabular grain population accounted for approximately 70% of the total projected area of the emulsion grains. The results are given in Table I.

X-ray powder diffraction data showed that 2 phases were present. One phase (the core) was 100 mole AgCl, and the second phase was 49 mole % AgBr, 12 mole % AgI, and 39 mole % AgCl.

TABLE I

| Emulsion | Average Diameter | Average Thickness | Volume of Band* | Volume of Shell Over Major {111} Core Faces* | Band % of Total Shell |
|---|---|---|---|---|---|
| Core Emulsion A | 2.0 | 0.08 | none | N.A. | N.A.** |
| Example 1 | 2.8 | 0.08 | 0.241 | ~0.00 | ~100 |
| Example 2 | 2.8 | 0.08 | 0.241 | ~0.00 | ~100 |
| Example 3 | 2.8 | 0.08 | 0.241 | ~0.00 | ~100 |
| Control 4 | 2.1 | 0.13 | 0.0419 | 0.157 | 21 |
| Example 5 | 2.5 | 0.085 | 0.150 | 0.0157 | 90.5 |

*The average volume of the band was calculated by multiplying the average increase in the projected area of the final grains by their thickness. The volume of the shell over the core was calculated by multiplying the average thickness increase by the average projected area of the core emulsion.
**not applicable Control Example 6

Repeat of U.S. Pat. No. 5,035,992, Example 1

This control was made following the emulsion making and bromide treatment procedure given in Houle and Tufano U.S. Pat. No. 5,035,992, Example 1.

The resulting tabular grain emulsion was comprised of tabular grains having an average ECD of 2.8 μm, an average thickness of 0.10 μm, and an average aspect ratio of 28. The tabular grain population accounted for 70% of the projected area of the emulsion grains.

X-ray powder diffraction data showed that 2 phases were present. One phase (the core) was 100 mole % AgCl, and the other, much smaller phase had an average composition of 85 mole % AgCl and 15 mole % AgBr. No high AgBr phase was observed.

Control Example 7

Testing Compounds as AgBr Tabular Grain Growth Modifiers

At 40° C. to 0.021 mole Emulsion D was added with stirring, 0.0032 mole Emulsion E. The pBr was adjusted to 3.55. A solution of the potential tabular grain growth modifier was added in the amount of 7.0 mole/mole Ag. The mixture was adjusted to a pH of 6.0 then heated to 70° C., the pH was again adjusted to 6.0. After heating for 17 hr at 70° C., the resulting emulsions were examined by optical and electron microscopy to determine mean diameter and thickness. The compounds tested for utility as AgBr grain growth modifiers and the results are given in Table II.

TABLE II

| Emulsion | Potential AgBr Tabular Grain Growth Modifier | Average {111} Tabular Grain Dimensions (μm) | % Projected Area of Nontabular Grains | % Projected Area as {111} Tabular Grains |
|---|---|---|---|---|
| Core Emulsion E | N.A.* | 1.3 × 0.04 | 5% | 95% |
| Control 7A | none | 1.7 × 0.18 | 40% | 60% |
| Control 7B | adenine | None | 100% | 0% |
| Control 7C | xanthine | 1.3 × 0.20 | 60% | 40% |
| Control 7D | 4-aminopyrazolo-[3,4-d]pyrimidine | 2.0 × 0.20 | 10% | 90% |
| Control 7E | 4,5,6-triaminopyrimidine | 4.3 × 0.042 | <5% | >95% |
| Control 7F | 2,4,6-triiodophenol | 4.0 × 0.055 | 18% | 82% |

**Not Applicable

As the above results show, only Control Emulsion 7E (4,5,6-triaminopyrimidine) and Control Emulsion 7F (2,4,6-triiodophenol) yielded tabular grains having reduced thickness relative to Control Emulsion 7A. Control Emulsion 7A, with no added tabular grain growth modifier, resulted in significant thickness growth compared to the core emulsion. Control Emulsion 7B (adenine) yielded nontabular grains, including large grains lacking {111} major faces.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium and silver halide grains, at least 50 percent of total grain projected area being accounted for by tabular grains of a face centered cubic crystal lattice structure having parallel {111} major faces and an average aspect ratio of at least 5, the tabular grains each being comprised of a central region and a shell differing in halide content, wherein the halide content of the central region is greater than 50 mole percent chloride, the halide content of the shell is less than 40 mole percent chloride, the shell is comprised of a band extending laterally outwardly from the central region and forming at least 25 percent of the {111} major faces, the band accounting for at least half the volume of the shell, and the emulsion contains a 4,5,6-triaminopyrimidine, a polyiodophenol or an iodo-8-hydroxyquinoline grain growth modifier.

2. A radiation-sensitive emulsion according to claim 1 wherein the tabular grains accounting for at least 50 percent of total grain projected area have an average thickness of less than 0.2 μm.

3. A radiation-sensitive emulsion according to claim 2 wherein the tabular grains accounting for at least 50 percent of total grain projected area have an average thickness of less than 0.07 μm.

4. A radiation-sensitive emulsion according to claim 1 wherein the band accounts for at least 70 percent of the silver contained in the shell.

5. A radiation-sensitive emulsion according to claim 4 wherein the band accounts for at least 80 percent of the silver contained in the shell.

6. A radiation-sensitive emulsion according to claim 5 wherein the band forms the only detectable portion of the shell.

7. A radiation-sensitive emulsion according to claim 1 wherein the shell is comprised of detectable surface regions interposed between the central region and the {111} major faces.

8. A radiation-sensitive emulsion according to claim 1 wherein the halide content of the central region is at least 70 mole percent chloride.

9. A radiation-sensitive emulsion according to claim 1 wherein the halide content of the band is at least 50 mole percent bromide.

10. A radiation-sensitive emulsion according to claim 9 wherein the halide content of the central region is at least 70 mole percent chloride.

11. A radiation-sensitive emulsion comprised of a dispersing medium and silver halide grains, at least 70 percent of total grain projected area being accounted for by tabular grains of a face centered cubic crystal lattice structure having parallel {111} major faces, an average thickness of less than 0.2 μm, and an average aspect ratio of at least 5, the tabular grains each being comprised of a central region and a shell differing in halide content, wherein the halide content of the central region is at least 70 mole percent chloride, the halide content of the shell is at least 70 mole percent bromide, the shell is comprised of a band extending laterally outwardly from the central region between the {111} major faces and forming at least 25 percent of the {111} major faces, the band accounting for at least 70 percent of the volume of the shell, and the emulsion contains a 4,5,6-triaminopyrimidine, a polyiodophenol or an iodo-8-hydroxyquinoline grain growth modifier.

* * * * *